US008450669B2

(12) United States Patent
Roy et al.

(10) Patent No.: US 8,450,669 B2
(45) Date of Patent: May 28, 2013

(54) PROJECTILE BODY EQUIPPED WITH DEPLOYABLE CONTROL SURFACES

(75) Inventors: Richard Roy, Bourges (FR); Simon Huguenin, Bourges (FR)

(73) Assignee: Nexter Munitions, Versailles (FR)

( * ) Notice: Subject to any disclaimer, the term of this patent is extended or adjusted under 35 U.S.C. 154(b) by 205 days.

(21) Appl. No.: 12/943,472

(22) Filed: Nov. 10, 2010

(65) Prior Publication Data

US 2011/0114783 A1 May 19, 2011

(30) Foreign Application Priority Data

Nov. 16, 2009 (FR) ..... 09.05494

(51) Int. Cl.
*F42B 15/01* (2006.01)
*B64C 1/24* (2006.01)
*B64C 9/34* (2006.01)

(52) U.S. Cl.
USPC ..... 244/3.27; 244/3.24; 244/3.26; 244/3.28; 244/3.29; 244/130

(58) Field of Classification Search
USPC ..... 244/24, 26, 27, 28, 130, 3.24, 3.26, 244/3.27, 3.28, 3.29
See application file for complete search history.

(56) References Cited

U.S. PATENT DOCUMENTS 3,853,288 A * 12/1974 Bode ..... 244/3.29
4,869,442 A 9/1989 Miller
6,260,797 B1 * 7/2001 Palmer ..... 244/49

FOREIGN PATENT DOCUMENTS

DE 3432614 A1 3/1986
WO WO 01/79779 A1 10/2001
WO WO 2009/051866 A1 4/2009

OTHER PUBLICATIONS

French Search Report issued in French Patent Application No. 09 05494 on Jun. 16, 2010 (with translation).

* cited by examiner

*Primary Examiner* — Tien Dinh
*Assistant Examiner* — Michael Wang
(74) *Attorney, Agent, or Firm* — Oliff & Berridge, PLC

(57) ABSTRACT

A projectile body intended to evolve in a fluid, such body equipped with at least two radially deployable control surfaces, such control surfaces being accommodated prior to their deployment in housings made in the body, such that the housings communicate at their intersection point, each housing being blocked by sealing device preventing any fluid from the exterior of the projectile body from passing through the housings when the control surfaces are deployed.

15 Claims, 7 Drawing Sheets

* B is not perpendicular to the longitudinal axis of the projectile

PROJECTILE BODY EQUIPPED WITH DEPLOYABLE CONTROL SURFACES

BACKGROUND OF THE INVENTION

1. Field of the Invention

The technical scope of the invention is that of projectiles equipped with deployable appendices around their periphery.

2. Description of the Related Art

The increasing sophistication of present-day projectiles aims to provide them with new functions requiring the deployment during the trajectory of sensors or actuators to the exterior of the projectile body. In the aim of improving accuracy, projectiles are, for example, equipped with air-brakes or deployable control surfaces such as those retained in the rest of the document by way of example.

The control surfaces used to orient the trajectory of a projectile are contained within the body of the projectile during its transport phase and/or during the first phase of its flight. Each control surface is positioned within the projectile thanks to a housing provided for it. It is advantageous for these control surfaces to be as wide as possible so as to optimize their influence on the trajectory once they have been deployed. However, the volume taken by these wide control surfaces causes a problem because of the limited depth of the housing provided to accommodate the control surfaces.

The invention proposes to overcome the problem linked to the volume of the control surface by making the control surface housings communicate with one another at their intersection. Using this solution creates problems, however, when the control surfaces are deployed, of aerodynamic perturbation on the control surfaces because of the air circulation through their empty housings.

To avoid air circulating in the control surface housing, a device is known by WO2009/051866 to block the openings of the control surfaces housings of the projectile by means of panels. However, these panels are ejected before the control surfaces are deployed. They are therefore ineffective during the flight of the projectile when the problem of aerodynamic perturbation arises.

SUMMARY OF THE INVENTION

The invention proposes to overcome this problem by preventing air from passing through the control surface housings once the control surfaces have exited their housings and this despite the movement of the control surfaces.

The invention thus relates to a projectile body enabling widened control surfaces to be installed without any perturbation to the aerodynamic behavior of the projectile once the control surfaces are deployed.

The invention thus relates to a projectile body intended to evolve in a fluid, such body equipped with at least two radially deployable control surfaces, such control surfaces being accommodated prior to their deployment in housings made in the body, body wherein the housings communicate at their intersection point, each housing being blocked by sealing means preventing any fluid from the exterior of the projectile from passing through it when the control surfaces are deployed.

According to one embodiment, the sealing means incorporate at least one hatch blocking off the housing at its outer end from the projectile body.

According to another embodiment, the sealing means incorporate tubular sectors positioned coaxially to the projectile at the intersection of the different control surface housings, such tubular sectors being integral with the projectile body and in contact with each other, two by two, by at least one generating line when the control surface is deployed, contact generating line that is in the same plane as that of the deployable control surfaces, tubular sectors in contact with the deployable control surfaces when these are in their retracted position.

The orientation of the sealing means will prevent fluid exiting through the housings.

BRIEF DESCRIPTION OF THE DRAWINGS

The invention will become more apparent from the following description of the embodiments, such description being made with reference to the appended drawings, in which.

DETAILED DESCRIPTION OF PREFERRED EMBODIMENTS

Figure 1:
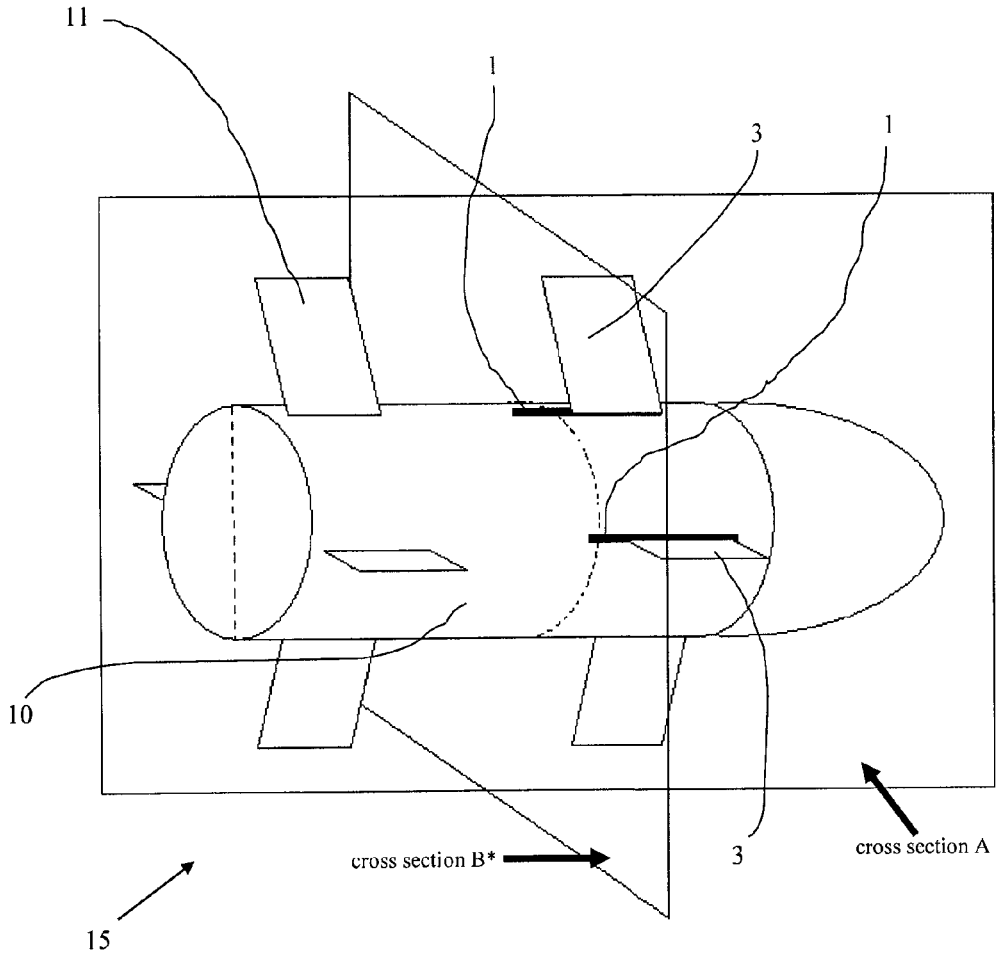
FIG. 1 schematically shows the projectile in a three-quarter rear view with the control surfaces and the rear stabilizing fins deployed. It locates the longitudinal section plane A and cross section plane B, FIG. 2 schematically shows the projectile at an incidence angle following longitudinal section A.
Figure 2:
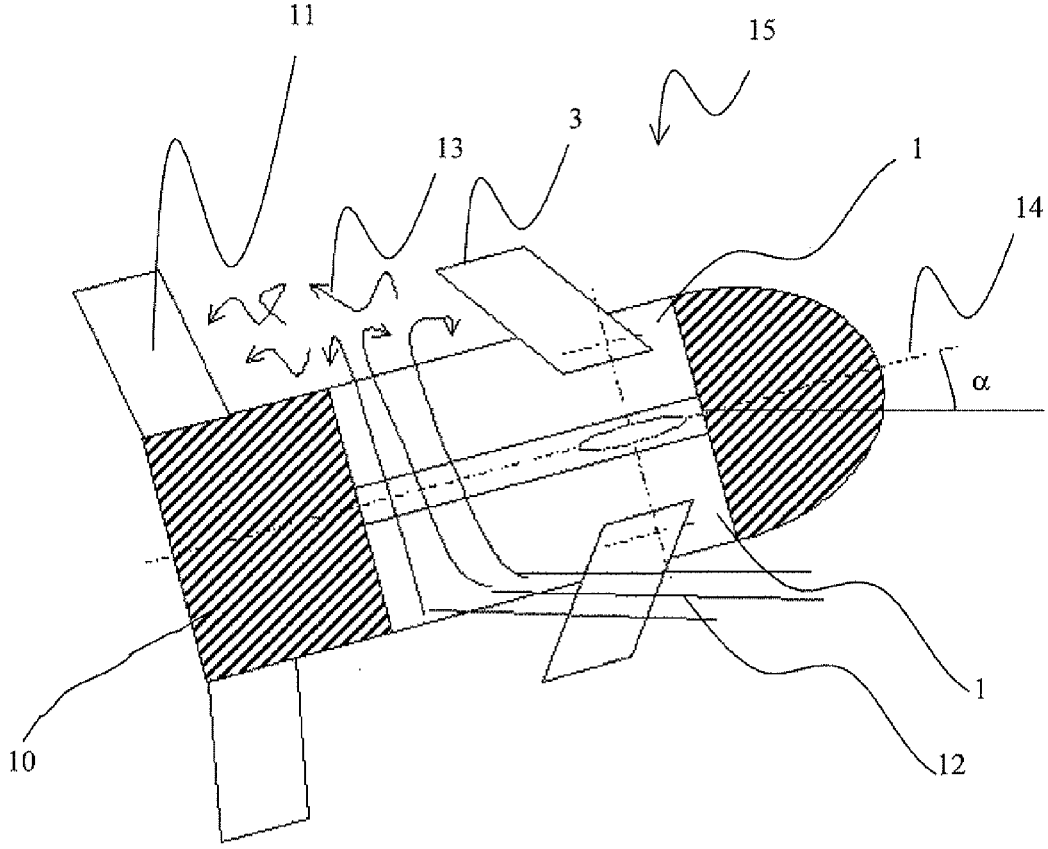

With reference to FIGS. 1 and 2, a projectile 15 is composed of a body 10, stabilizing fins 11, control surfaces 3 and housings 1 for these control surfaces. In flight, the control surfaces 3 are deployed as shown in FIG. 1 and the housings 1 are thus empty. The wider the control surfaces 3 the more effective they are but also the more volume they take up when retracted into the projectile body 10.

Figure 3:
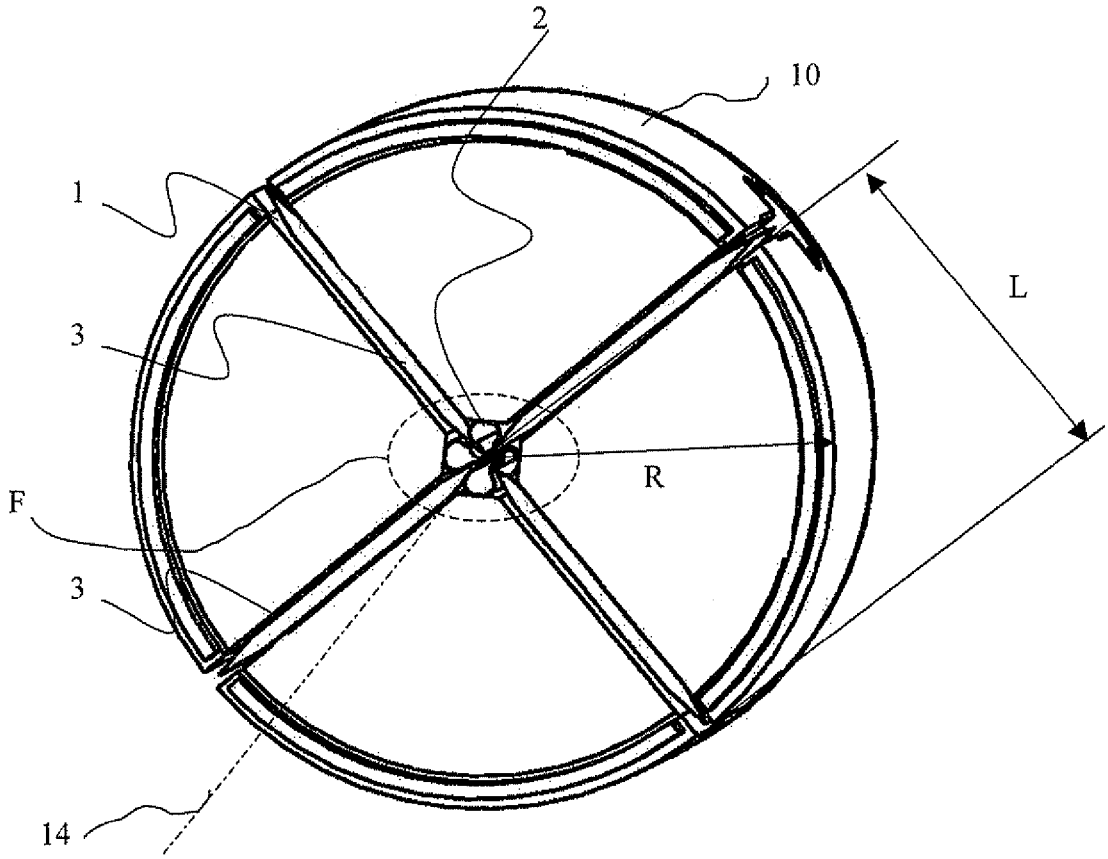
FIG. 3 shows the projectile with its control surfaces retracted in their housings following cross section B.

According to a first characteristic of the invention more particularly visible in FIG. 3, the housings 1 communicate at the axis 14 of the projectile so as to employ control surfaces 3 of a width L substantially equal to the radius R of the projectile body.

As illustrated in FIG. 2, the projectile 15 may be at an angle of incidence in trajectory. Because of this the air flow 12 is not perfectly parallel to the axis 14 of progression of the projectile but is at an angle $\alpha$ The incidence angle shown here makes a depression appear on the external surface of the body 10 at the upper part of the projectile and a wisp of air 12 enters through the housings 1 of the control surfaces 3.

These wisps of air exit through the control surface housing lying opposite with the risk of creating turbulence 13 and perturbing the effectiveness of the control surfaces. It is necessary for such an air flow to be eliminated.

Figure 4:
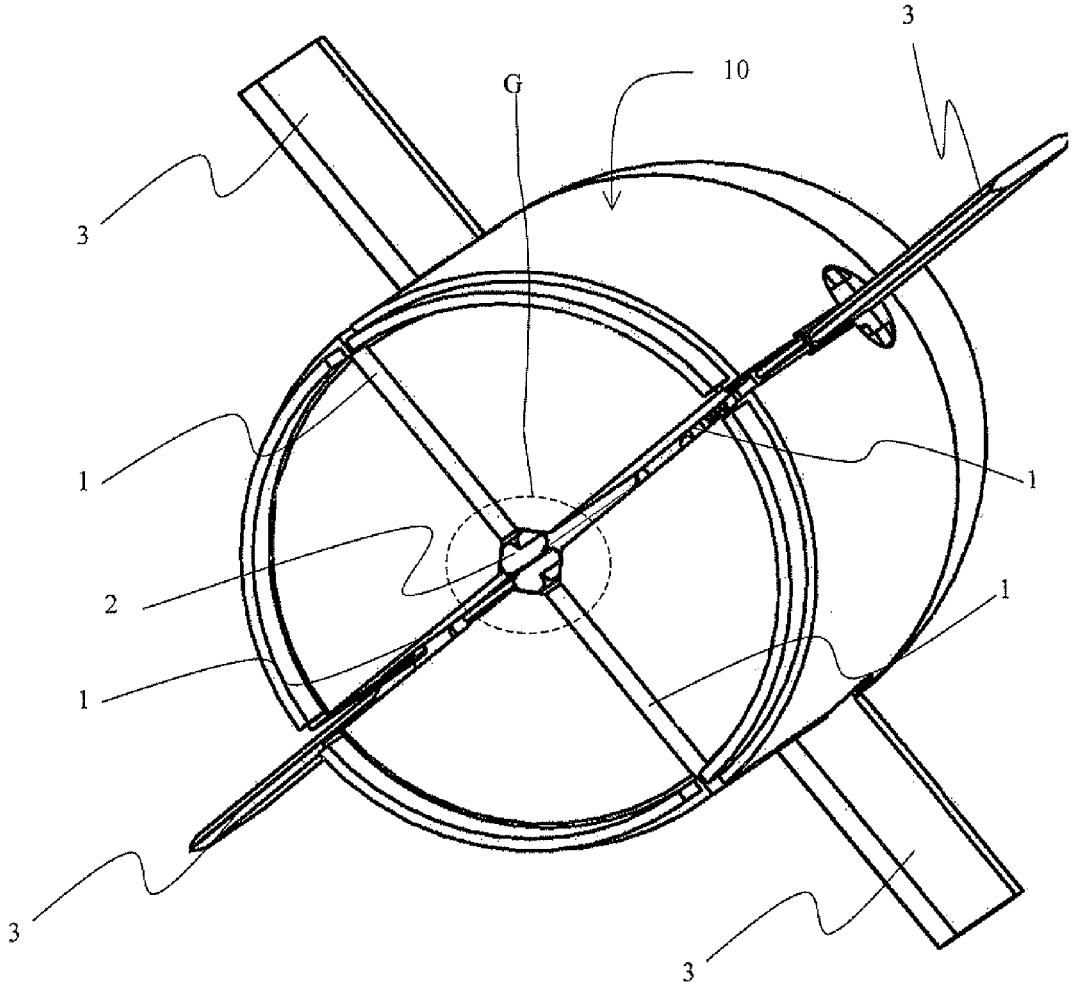
FIG. 4 shows the projectile with its control surfaces deployed following cross section B.

So as to eliminate this parasitic flow, according to a second characteristic of the invention, a sealing device 2 is added such as that shown in FIGS. 3 and 4.

Figure 3A:
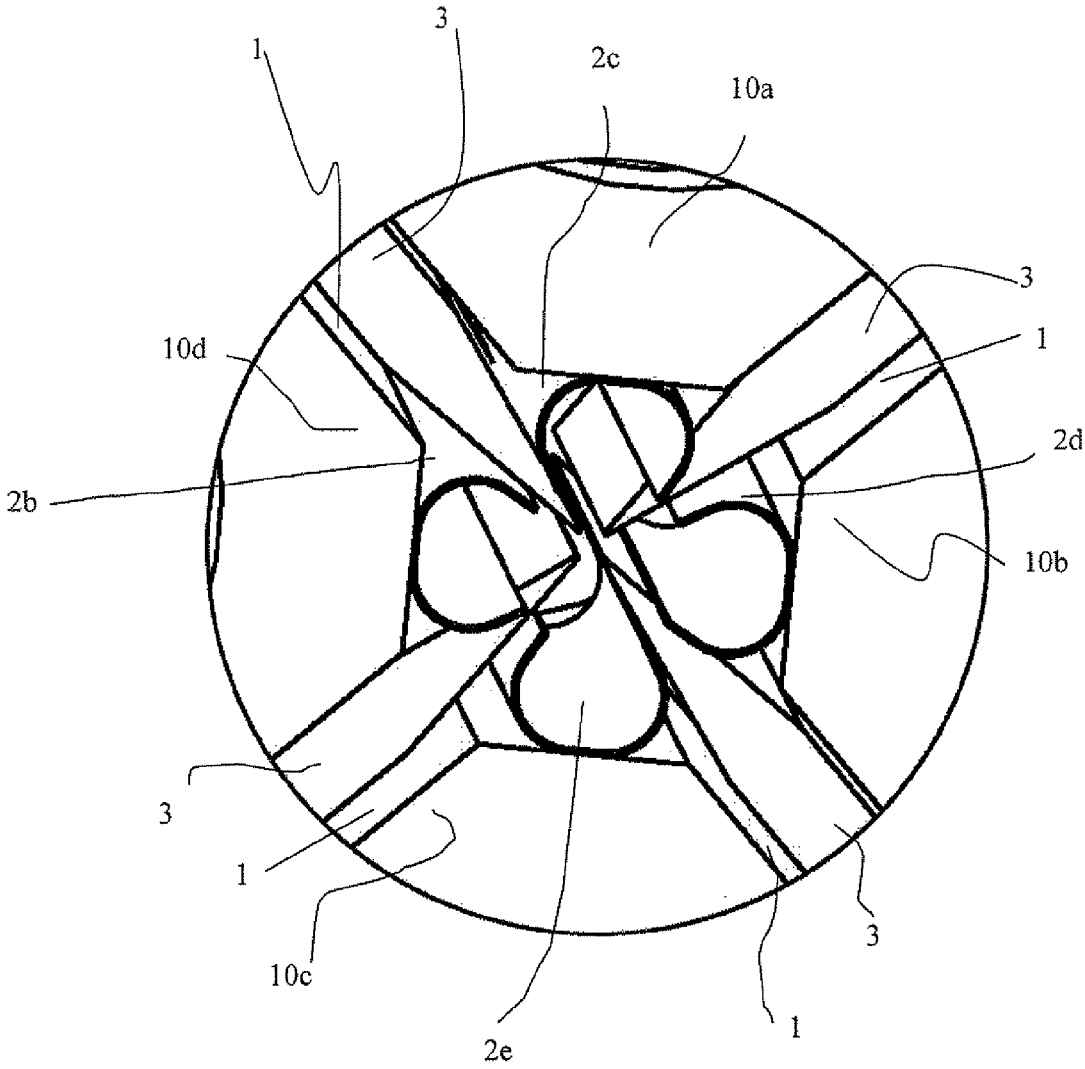
FIG. 3*a* shows an enlarged detail view of reference F in FIG. 3.
Figure 4A:
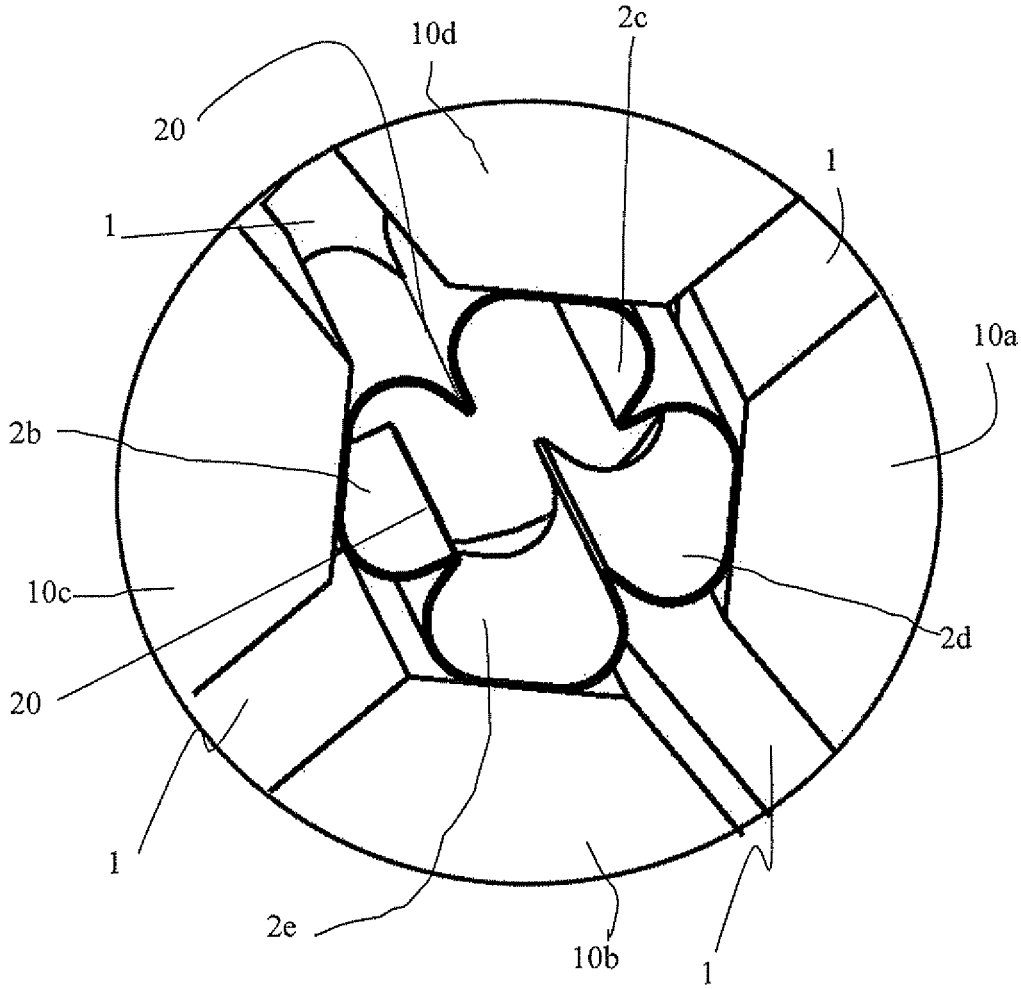
FIG. 4*a* shows an enlarged detail view of reference G in FIG. 4.

According to a first embodiment shown in FIGS. 3 and 4 in the dotted circles referenced F and G that are detailed in FIGS. 3*a* and 4*a*, the sealing device 2 is formed by a section of flexible tubing 2*b*, 2*c*, 2*d* and 2*e*, that can be polyethylene with a thickness of 0.5 mm. Each section is integral with a sector of the projectile body 10*a*, 10*b*, 10*c* and 10*d*. These sectors are made integral with the projectile body 10 by mechanical means, not shown. The tubular sections are placed edge to edge with the edges being slightly compressed so as to form a lip 20 turned in towards the projectile body. The lip thus formed must be in the same central plane as that of the control surface 3. The lip 20 will thereafter prevent air flowing from the interior to the exterior of the body.

When the control surfaces 3 are in their retracted position, the lip 20 can allow the end of the control surface to pass, as shown in FIG. 3*a*, whilst retaining its airtight characteristics by contact between the tubular sectors and the control surface on either side of the latter.

Figure 5A:
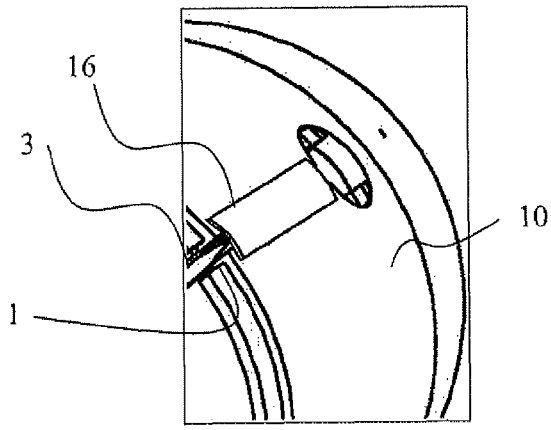
FIG. 5*a* shows, according to another embodiment, a detail view of the projectile body and one of its control surfaces retracted in its housing blocked by an external sealing device.
Figure 5B:
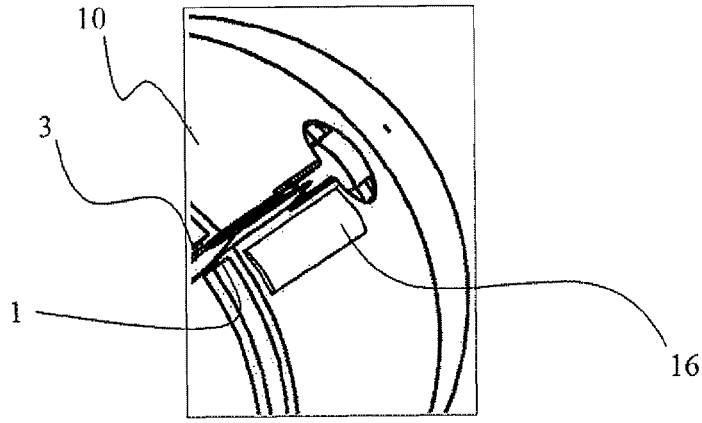
FIG. 5*b* shows a detail view of the projectile body and one of its control surfaces in its housing where the external sealing device is pushed to one side.
Figure 5C:
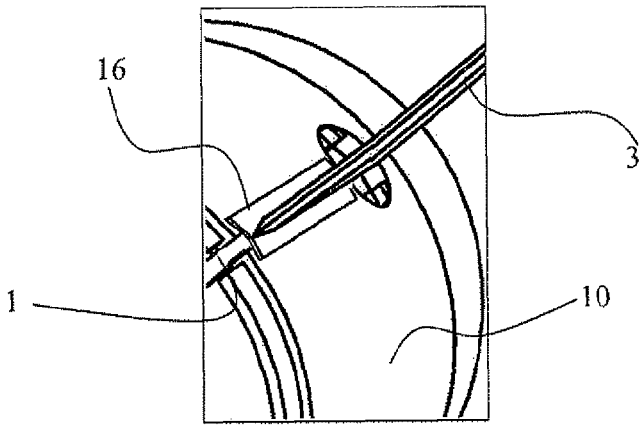
FIG. 5*c* shows a detail view of the projectile body and one of its control surfaces out of its housing and where the external sealing device has taken up its position to block the housing.

FIGS. 5*a* to 5*c* show a second embodiment in which the sealing means will be formed by a sliding hatch 16 on each control surface 3.

In the retracted position of the control surface 3, this hatch will block the housing 1 in an airtight manner (using a seal, for example) such as shown in FIG. 5*a*.

Before the control surface 3 is deployed, the hatch 16, driven by a motor, not shown, will slide to one side as shown in FIG. 5*b* to unblock the housing 1.

As shown in FIG. 5*c*, once the control surface 3 has been deployed, the hatch 16 will take up its initial position by sliding between the projectile body 10 and the control surface 3 thanks to the motor, not shown.

In this way, no air flow will come and perturb the functioning of the control surfaces.

The invention claimed is:

1. A projectile body intended to evolve in a fluid, comprising:

at least two housings disposed inside said body capable of communicating with an exterior of said projectile body via an opening; and at least two control surfaces configured to deploy by moving rectilinearly in a radial direction, said control surfaces being disposed prior to their deployment inside the respective housings, wherein said housings communicate at their intersection point, said housings being blocked by a sealing device preventing any fluid from the exterior of said projectile body from passing through said housings when said control surfaces are deployed, wherein said sealing device incorporates tubular sectors positioned coaxially to said projectile at the intersection of the different control surface of said housings, said tubular sectors being integral with said projectile body and in contact with each other by at least one generating line when said control surface is deployed, contact generating line that is in the same plane as that of said deployable control surfaces, such that contact generating line forms an airtight seal, said tubular sectors being in contact with said deployable control surfaces when said control surfaces are in their retracted position.

2. The projectile body according to claim 1, wherein the orientation of said sealing device prevents fluid exiting through said housings.

3. The projectile body according to claim 1, wherein each tubular sector is made of polyethylene.

4. The projectile body according to claim 1, wherein each tubular sector is 0.5 mm thick.

5. The projectile body according to claim 1, wherein the sealing device prevents any fluid from the exterior of said projectile body from passing through said housings when the control surfaces are deployed and when the control surfaces are retracted.

6. The projectile body according to claim 1, wherein each housing forms a separate cavity for a single control surface and each control surface is disposed prior to deployment inside the respective cavity.

7. A projectile body intended to evolve in a fluid, comprising:

at least two housings disposed inside said body capable of communicating with an exterior of said projectile body via an opening; and at least two control surfaces configured to deploy by moving rectilinearly in a radial direction, said control surfaces being disposed prior to their deployment inside the respective housings, wherein said housings communicate at their intersection point, said housings being blocked by first and second sealing devices preventing any fluid from the exterior of said projectile body from passing through said housings when said control surfaces are deployed, wherein said first sealing device incorporates for each housing at least one hatch blocking off the respective opening of the housing, and wherein the second sealing device incorporates tubular sectors positioned coaxially to said projectile at the intersection of the different control surface of said housings, said tubular sectors being integral with said projectile body and in contact with each other by at least one generating line when said control surface is deployed, contact generating line that is in the same plane as that of said deployable control surfaces, such that contact generating line forms an airtight seal, said tubular sectors being in contact with said deployable control surfaces when said control surfaces are in their retracted position.

8. The projectile body according to claim 7, wherein each hatch slides between the projectile body and the respective control surface.

9. The projectile body according to claim 7, wherein each hatch slides across an outer surface of the projectile body.

10. The projectile body according to claim 7, wherein a width of the control surface is substantially equal to a radius of the projectile body.

11. The projectile body according to claim 7, wherein the first and second sealing devices prevent any fluid from the exterior of said projectile body from passing through said housings when the control surfaces are deployed and when the control surfaces are retracted.

12. The projectile body according to claim 7, wherein each housing forms a separate cavity for a single control surface and each control surface is disposed prior to deployment inside the respective cavity.

13. A projectile body intended to evolve in a fluid, comprising:

at least two housings disposed inside said body capable of communicating with an exterior of said projectile body via an opening; and at least two control surfaces configured to deploy by moving rectilinearly in a radial direction, said control surfaces being disposed prior to their deployment inside the respective housings, wherein said housings communicate at their intersection point, said housings being blocked by first and second sealing devices preventing any fluid from the exterior of said projectile body from passing through said housings when said control surfaces are deployed, wherein the orientation of said first sealing device prevents fluid exiting through said housings, and wherein the second sealing device incorporates tubular sectors positioned coaxially to said projectile at the intersection of the different control surface of said housings, said tubular sectors being integral with said projectile body and in contact with each other by at least one generating line when said control surface is deployed, contact generating line that is in the same plane as that of said deployable control surfaces, such that contact generating line forms an airtight seal, said tubular sectors being in contact with said deployable control surfaces when said control surfaces are in their retracted position.

14. The projectile body according to claim 13, wherein the first and second sealing devices prevent any fluid from the exterior of said projectile body from passing through said housings when the control surfaces are deployed and when the control surfaces are retracted.

15. The projectile body according to claim 13, wherein each housing forms a separate cavity for a single control surface and each control surface is disposed prior to deployment inside the respective cavity.

* * * * *